United States Patent [19]

Jageler et al.

[11] 4,449,593

[45] May 22, 1984

[54] GUIDE FOR SIDEWALL CORING BIT ASSEMBLY

[75] Inventors: Alfred H. Jageler; Gary D. Bruce; Houston B. Mount, II, all of Tulsa, Okla. 74135

[73] Assignee: Standard Oil Company, Chicago, Ill.

[21] Appl. No.: 426,304

[22] Filed: Sep. 29, 1982

[51] Int. Cl.[3] ..... E21B 49/06

[52] U.S. Cl. ..... 175/58; 175/77; 175/78

[58] Field of Search ..... 175/58, 77, 78, 311, 175/313; 73/864.45

[56] References Cited

U.S. PATENT DOCUMENTS

| | | | |
|---|---|---|---|
| 2,198,821 | 4/1940 | Jessup | 175/77 |
| 2,599,405 | 6/1952 | Mennecier | 175/40 |
| 3,630,296 | 12/1971 | Bullard | 175/77 |
| 3,817,337 | 6/1974 | Panak et al. | 175/313 X |
| 4,280,569 | 7/1981 | Mount | 175/26 |

*Primary Examiner*—Ernest R. Purser
*Assistant Examiner*—Thuy M. Bui
*Attorney, Agent, or Firm*—J. D. Gassett

[57] ABSTRACT

This relates to sidewall coring tools used to obtain samples of the formation through which the wellbore is drilled. It includes a housing which supports a guide means along which the drill bit, core barrel and motor can be moved to extend or retract the cutting bit and core barrel along a selected path. The core barrel is retracted inwardly on a horizontal path and tilted in an upward position such that the outer end of the core barrel is higher than the end near the motor. Means are provided to force the cut core from the barrel into a core container in association with indexing means.

17 Claims, 28 Drawing Figures

FIG. 3A
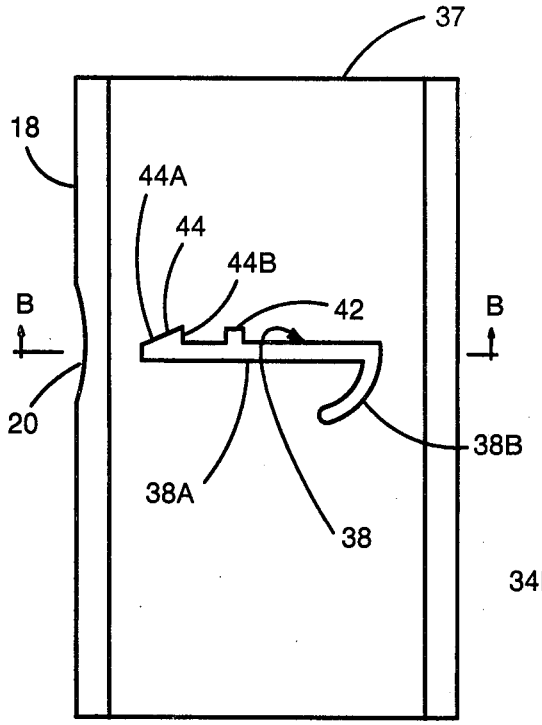
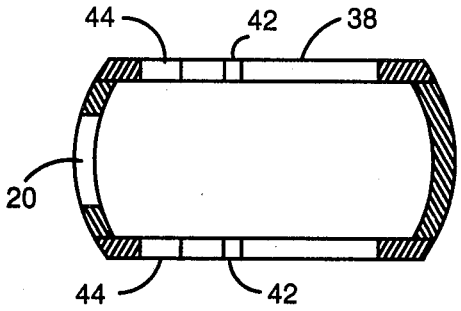
FIG. 3B
FIG. 4A
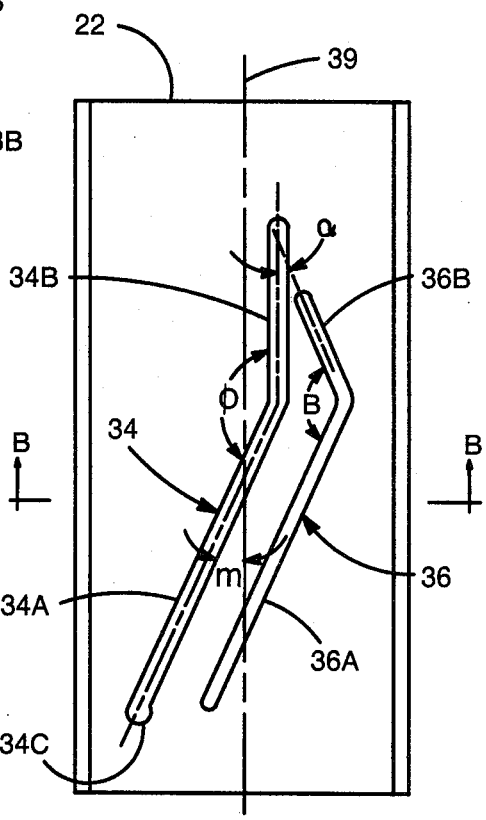
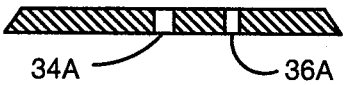
FIG. 4B

FIG. 21
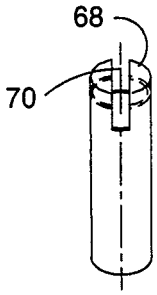
FIG. 19
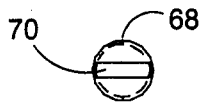
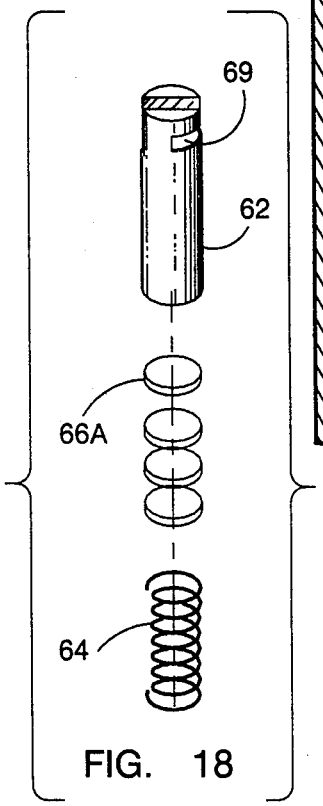
FIG. 18
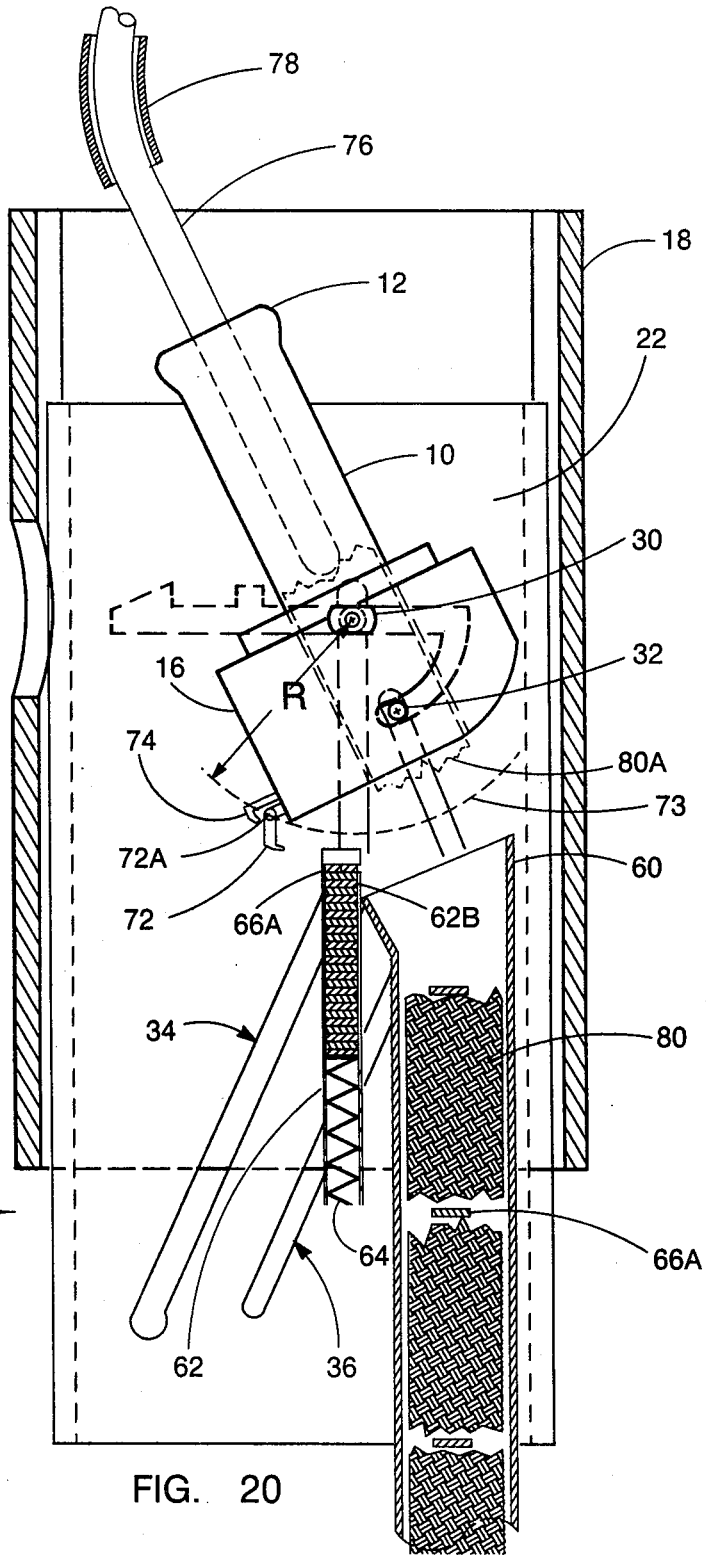
FIG. 20

GUIDE FOR SIDEWALL CORING BIT ASSEMBLY

RELATED APPLICATIONS

This application is related to copending application Ser. No. 321,655, filed Nov. 16, 1981, entitled "Drill Bit Extension for Sidewall Corer" for A. H. Jageler, et al., and Ser. No. 356,613, filed Mar. 9, 1982, now abandoned entitled "Bit Extension Guide for Sidewall Corer", Houston B. Mount, II, Inventor.

BACKGROUND OF THE INVENTION

This invention relates to sidewall coring tools used to obtain samples of the formation through which a wellbore is drilled. In determining the physical properties of subterranean formations, it is of great assistance to have samples of the formation which are commonly called cores. A core is typically a cylindrical piece of the rock which has been cut from the underground formation and can vary in size and length. A typical size is ½ inch in diameter and 4 to 6 inches long although samples can be of larger diameter and of greater length, depending on the facilities available. One type of core cutter is the type that can be used to cut the cores from the sidewall of a borehole after the borehole has already been drilled. Such a sidewall coring tool is described in U.S. Pat. No. 4,280,569, issued July 28, 1981 to Houston B. Mount, II, inventor, and Standard Oil Company (Indiana) assignee. This invention relates to such a sidewall coring tool.

SUMMARY OF THE INVENTION

This invention relates to an apparatus and method for use in cutting a sidewall core in a borehole drilled in the earth. This includes an elongated frame or a housing (usually cylindrical) which supports a guide means along which the drill bit and motor of the apparatus can be moved to extend and retract the cutting bit and core barrel along a selected path through an opening in the housing. The path is such that it causes the coring bit to cut a core horizontally—that is perpendicular to the longitudinal axis of the housing. Once the core has been cut, the core barrel is retracted inwardly into the housing and tilted into an upward position such that the outer or bit end of the core barrel is at a higher elevation than the other end of the core barrel near the motor. When the core barrel with the cut core therein is tilted to its uppermost position, the core is driven downward through the core barrel and a center opening in the motor where it is dropped into a core container. Indexing means are provided so that the depth in the borehole at which the core was cut can be determined when the coring tool is removed to the surface.

The guide means includes a fixed plate and a drive plate. The fixed plate is secured to the housing and has a guide slot means including a first substantially straight section which is horizontal when the tool is in an upright position and is in effect perpendicular to the longitudinal axis of the housing. The guide slot means also includes an arcuate section which is at one end of the straight section. A drive plate is adjacent to the fixed plate and movable with respect to the housing and in a direction parallel to the longitudinal axis of the housing. Drive means are provided to move the drive plate and there is provided a core cutting assembly mounted in said housing and having guide means engaging the straight section and said arcuate section to extend and retract the core cutting assembly through the opening of the housing in response to the movement of the drive plate.

g,4

The drive plate has a drive plate slot means including a forward slot having a lower section and an upper straight section with an angle $\emptyset$ there between, and a trailing slot having a lower straight section parallel to the lower straight section of the forward slot and an upper straight section making an angle $\beta$ with said lower straight section of the trailing slot and the angle $\beta$ being smaller than the angle $\emptyset$.

Opposite sides of the motor which rotates the drill bit are provided with two pins or pinions which fit into the various slots on the movable and fixed plates. Means are provided to move the movable drive plate between an upper and lower position. It is this movement of this movable drive plate which causes the pins of the motor to follow the various guide means of the fixed plate and the drive plate thus causing the motor to rotate, extend, retract and rotate again as will be described further herein.

A better understanding of the invention may be had from the following description taken in conjunction with the drawing.

BRIEF DESCRIPTION OF THE DRAWINGS

FIG. 3A is a view of the fixed plate showing the horizontal section and arcuate section of the fixed slot.

FIG. 3B is a view taken along the line B—B of FIG. 3A.

FIG. 4A is a schematic view of the drive plate showing the pair of slots therein.

FIG. 4B is a section taken along the line B—B of FIG. 4A.

FIG. 7A is an isometric view showing the guide pinions of the motor.

FIG. 18 shows an enlarged exploded view of the indexing wafer retaining tube.

FIG. 19 shows the top view of the cap of the indexing wafer retaining tube of FIG. 18.

FIG. 20 is similar to FIG. 17 except the core cutting assembly is in its uppermost tilted position with push rod forcing a core from the core barrel.

FIG. 21 shows the indexing wafer tube proper rotated 90° from the view of FIG. 18.

DETAILED DESCRIPTION OF THE INVENTION

Figure 1:
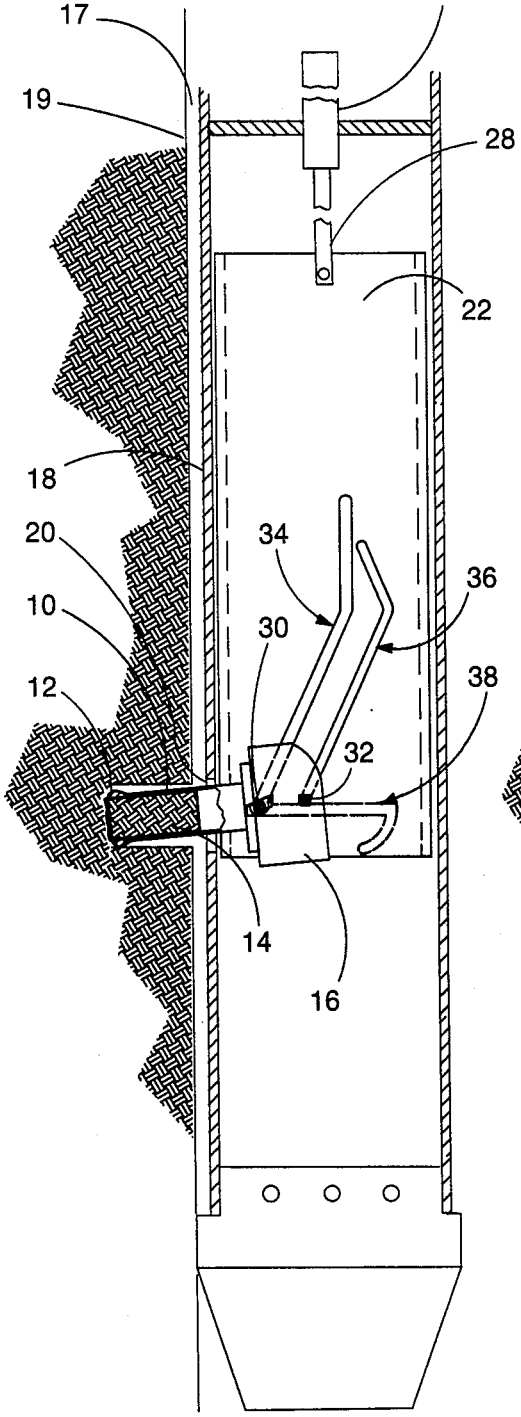
FIG. 1 is a schematic view depicting a core cutting means suspended in the borehole with a core bit and core barrel fully extended and containing a cut core.

FIG. 1 illustrates a core retaining barrel 10 having a core bit 12 in an extended position and also containing a cut core 14. The core bit 12 is rotated by barrel 10 connected to a motor 16 which is preferably hydraulic. The motor is supported within an elongated frame member 18 which is preferably a steel cylinder having an opening 20 through which the core barrel 10 extends. Elongated member 18 is suspended by means not shown in a hole 17 having a sidewall 19. Power for rotating the hydraulic motor 16 is provided by means not shown which can be similar to that shown in said U.S. Pat. No. 4,280,569. Also shown in FIG. 1 is drive plate 22 which is slidable with respect to housing 18. Plate 22 is slidably mounted by any well-known means such as bearings from the housing 18. Drive motor 26 having ram 28 is supported from housing 18. Ram 28 is connected to movable plate 22 and is used for moving the drive plate 22 in either an up or down direction. Motor 16 has forward pinion 30 and trailing pinion 32. Drive plate 22 has a forward slot 34 and a trailing slot 36. The fixed plate has a slot means 38. As will be explained, it is the cooperation of slots 34, 36 of drive plate 22 and slot 38 of the fixed plate and pinions 30 and 32 of motor 16 which controls the extension and retraction of core barrel 14. It is thus seen that there is preferably one power source for driving the plate 22 which in turn extends and retracts the core barrel 10 and associated bit 12. There is preferably a second hydraulic system which is connected through conduits not shown to motor 16 to cause it to rotate. These two hydraulic sources can be the same as that shown in U.S. Pat. No. 4,280,569.

Figure 2:
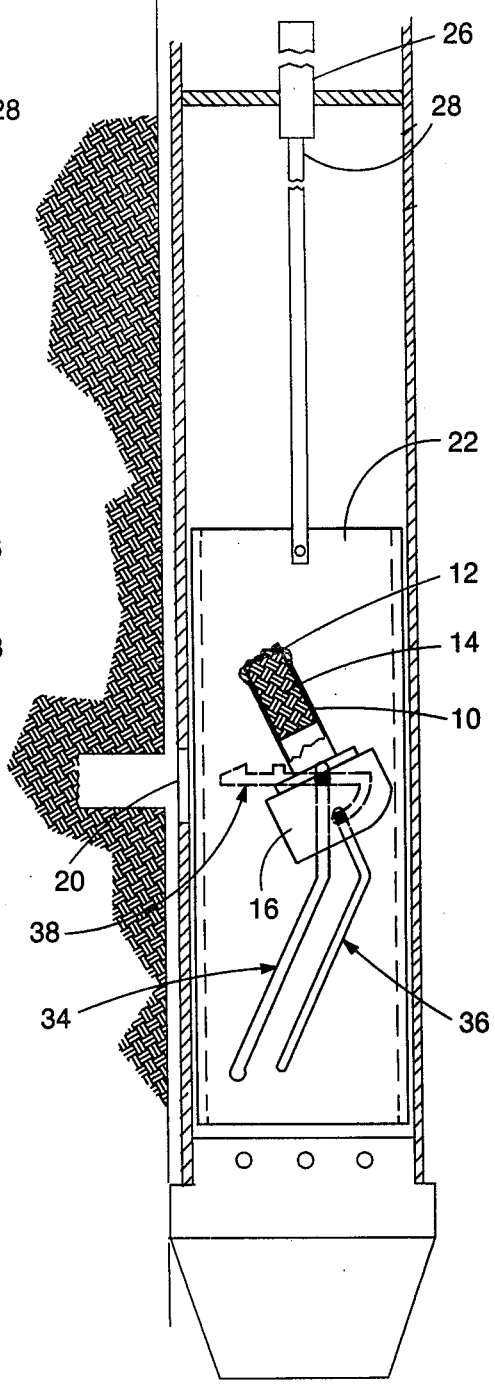
FIG. 2 is a schematic view depicting the core cutting means of FIG. 1 in a retracted position with a retained core.

FIG. 2 is similar to FIG. 1 except the core barrel with the core has been retracted and is in an upwardly tilted position. It is to be noted that the core barrel is either in a horizontal position as shown in FIG. 1 or in a tilted position such as shown in FIG. 2. This is most important as it prevents the possible loss of the core if the core should be fractured which might occur if the bit end of the core barrel should be tilted downwardly upon retraction.

Figure 5:
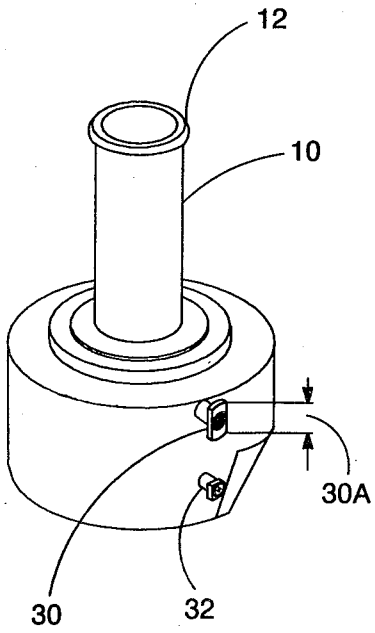
FIG. 5 is an isometric view of the motor, the core bit and core barrel.

FIGS. 3A and 3B illustrate the fixed plate and the fixed slot means and FIGS. 4A and 4B illustrate the sliding or drive plate and the sliding slots therein. In FIG. 3A, there is shown fixed slot 38 having a horizontal straight section 38A. On the other end of the straight section opposite the opening 20 is an arcuate section 38B. Horizontal section 38A is perpendicular to the longitudinal axis of the housing 18. It also has a first break slot 42 and a second break or clearance slot 44. These two slots are the same distance apart as are pinions 30 and 32 of motor 16. Forward pinion 30, which is illustrated in FIG. 1 and more clearly in FIG. 5, has a longitudinal dimension 30A which is greater than the width of slot 42. The trailing pinion 32 is of a dimension so it can enter slot 42. The reason for this will be explained later. As shown in FIG. 3A, slot 44 has a slightly sloping surface 44A and average depth 44B which is slightly shallower than the depth of slot 42. The arcuate section 38B has a radius equal to the distance between forward pinion 30 and trailing pinion 32. As will be seen, the horizontal section 38A together with the slots of the sliding plate 22 provides for the extension and retraction in a horizontal direction of the drilling assembly including the motor 16, core barrel 10 and bit 12. The arcuate section 38B in cooperation with the slots of the sliding plate provides for the tilting or rotation of the drilling assembly between the horizontal position of FIG. 1 and the tilted position as shown in FIG. 2.

Attention is next directed to FIG. 4A and 4B which shows the sliding or drive plate 22. It has a forward slot 34 and a trailing slot 36. Forward slot 34 has a lower section 34A which has a break slot 34C at the lower end. Forward slot 34 has an upper straight section 34B which makes an angle $\phi$ with the lower slot 34A. Trailing slot 36 has a lower section 36A which is parallel to the lower section 34A of the leading slot or forward slot and an upper section 36B which makes an angle $\beta$ with the lower section 36A. Angle $\beta$ is greater than the angle $\phi$. Angle $\phi$ and angle $\beta$ are such as to obtain the proper tilting of the drilling assembly in cooperation with the fixed slot 38. In a preferred embodiment, upper section 34B is parallel to the longitudinal axis 39 of the sliding plate 22. Thus, when in an upright position upper section 34B is vertical. In one preferred embodiment, angle $\phi$ between the lower section 34A and upper section 34B is approximately 155° and angle $\beta$ between the lower section 36A and upper section 36B is approximately 130°. Also in this preferred embodiment the angle m between section 34A and longitudinal axis 39 is approximately 30° and the angle of upper section 36B of trailing slot 36 makes an angle $\alpha$ with the line 39. Typically, angle $\phi$ can be between about 140° and 170°, angle b between about 120° and 140°, angle $\alpha$ between about 20° and 40° and angle m between about 20° and 40°. Typically, slot 34 extends through the sliding plate 22 and is typically about 0.252 inches in width. The lower break slot 34C has a configuration which can accommodate movement of and receive forward pinion 30. Fixed slot 38 may, but need not, extend through fixed plate 37. The width of fixed slot 38 is typically about 0.252 inches. Typically, the width of pinions 30 and 32 which slide through these various slots is about 0.25 inches which gives a clearance of about 0.002 inches. The slot must be at such an angle to provide the most force on the pinion for a given direction and with the least amount of friction.

Figure 6:
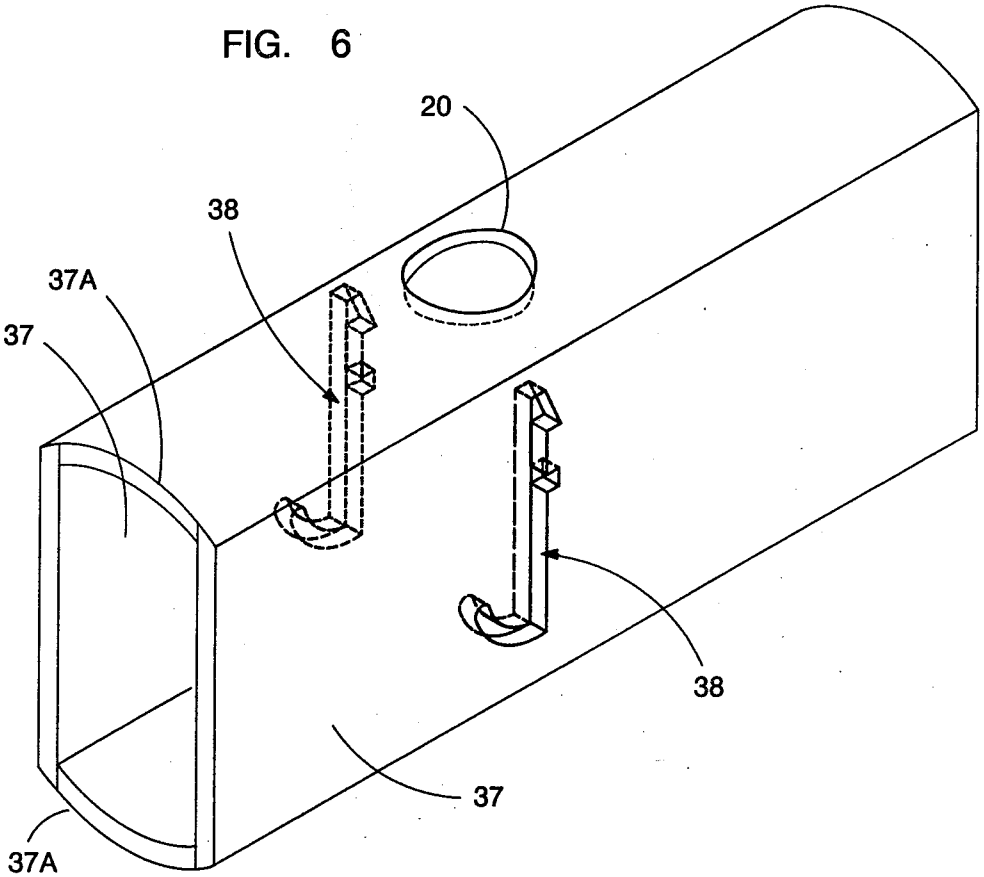
FIG. 6 is an isometric view showing the guide slot means in the fixed plates.

Attention is now directed to FIG. 6 which illustrates the fixed plate means shown in FIG. 3B in isometric form. Fixed plate 37 also has side members 37A which can be a part of the housing. The exterior of the housing 18 is preferably as illustrated in FIG. 1. However, this is not necessarily the case.

Figure 7:
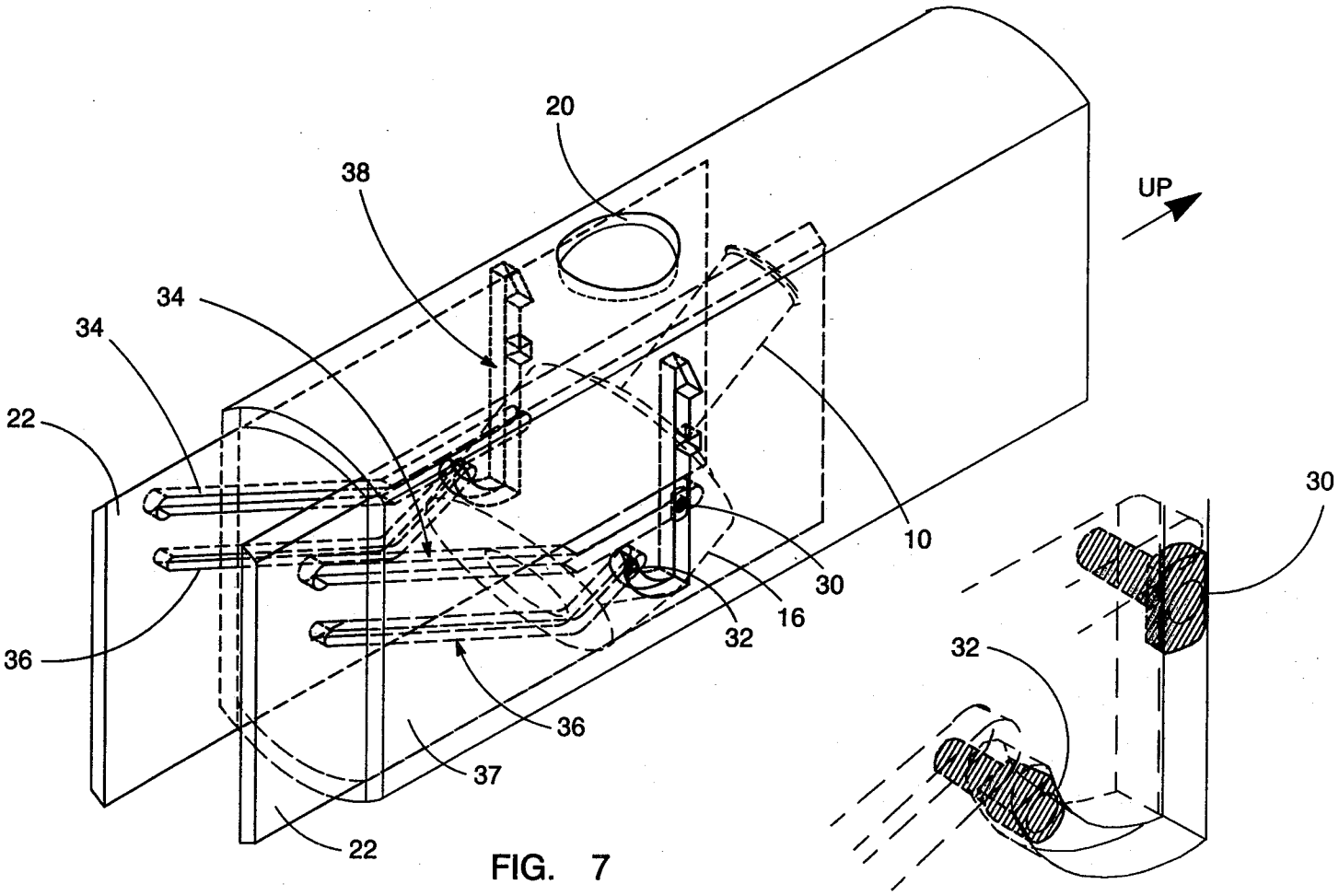
FIG. 7 is an isometric view showing the fixed plate in relation to the drive plates and motor and cutting assembly.
Figure 8:
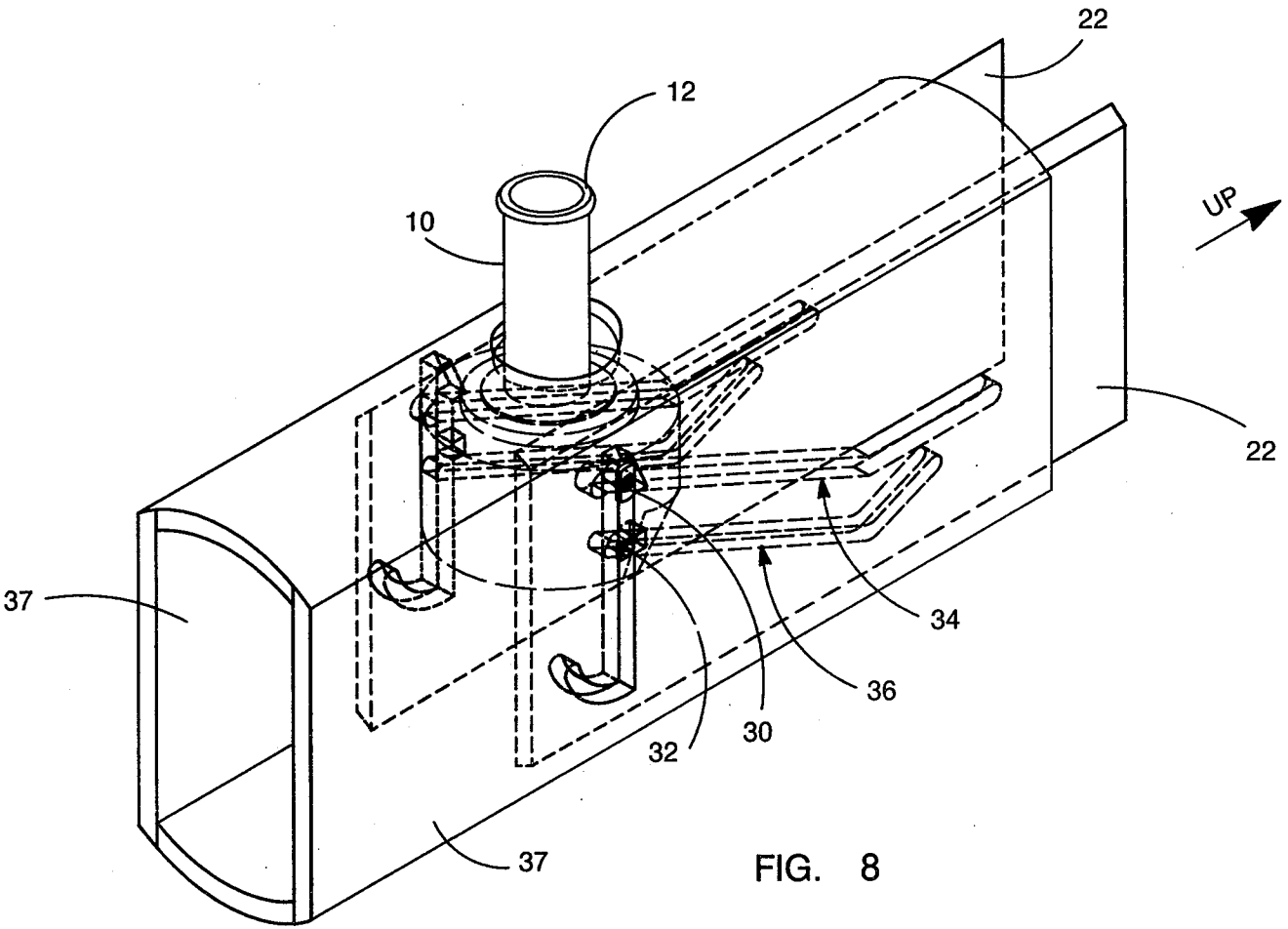
FIG. 8 is similar to FIG. 7 except that the motor and cutting assembly have been rotated and extended.
Figure 9:
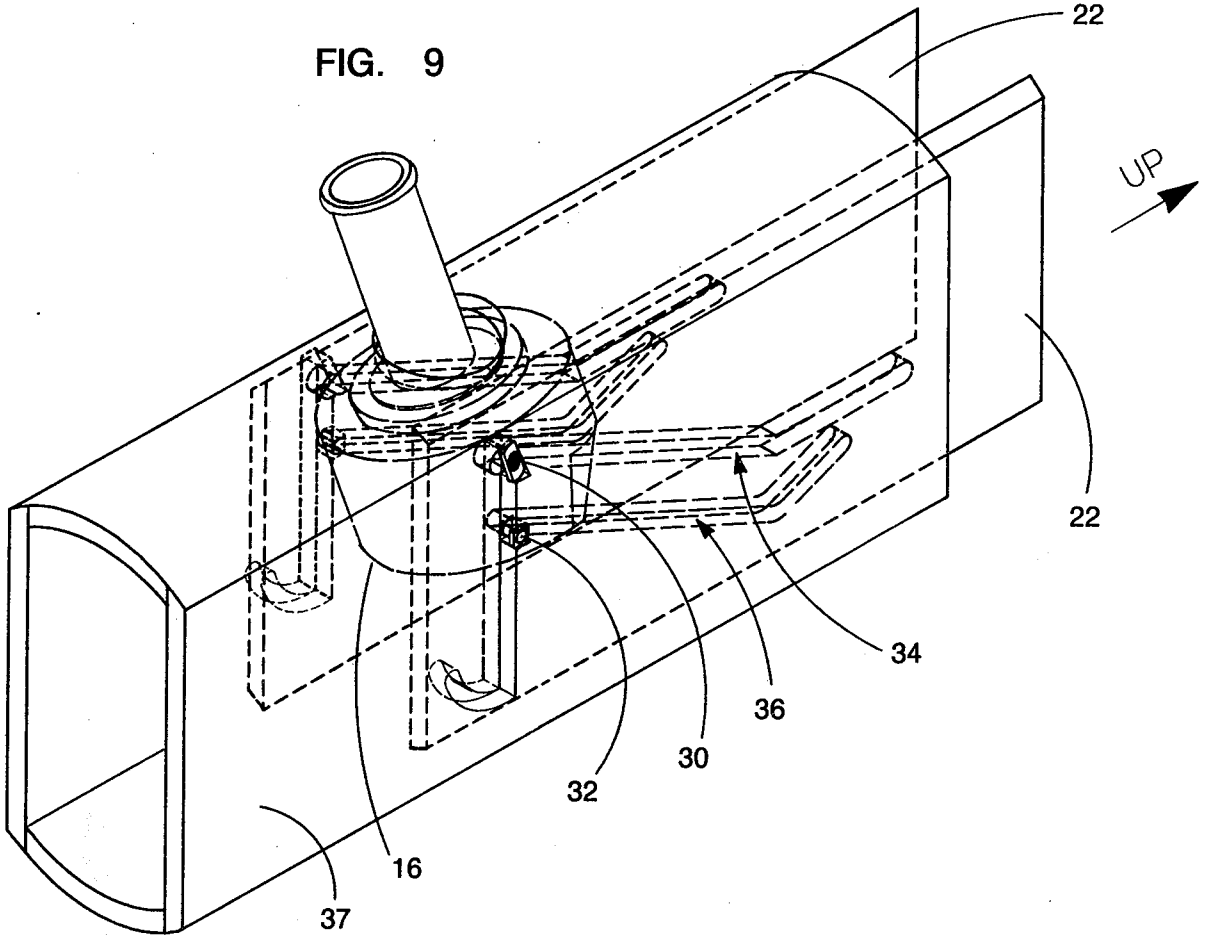
FIG. 9 is similar to FIG. 8 except that the core cutting mechanism has been tilted by the break mechanism.

Attention is next directed to FIG. 7 which is similar to FIG. 6 with the exception that the two sliding plates 22 and motor 16 with pinions 30 and 32 have been indicated therein. As can be seen, when in this position, core barrel 10 is tilted in an upwardly position. FIG. 7A shows the preferred shape in enlarged view of the pinion 30 and 32 of FIG. 7. FIG. 8 is similar to FIG. 7 except that the plates 22 have been moved upwardly with respect to fixed plate 37 such that core barrel 10 and bit 12 are in a horizontal position. FIG. 9 is similar to FIG. 8 except it shows that the pinions 30 and 32 are in the break slot positions and core barrel 10 has been tilted slightly.

Figure 10:
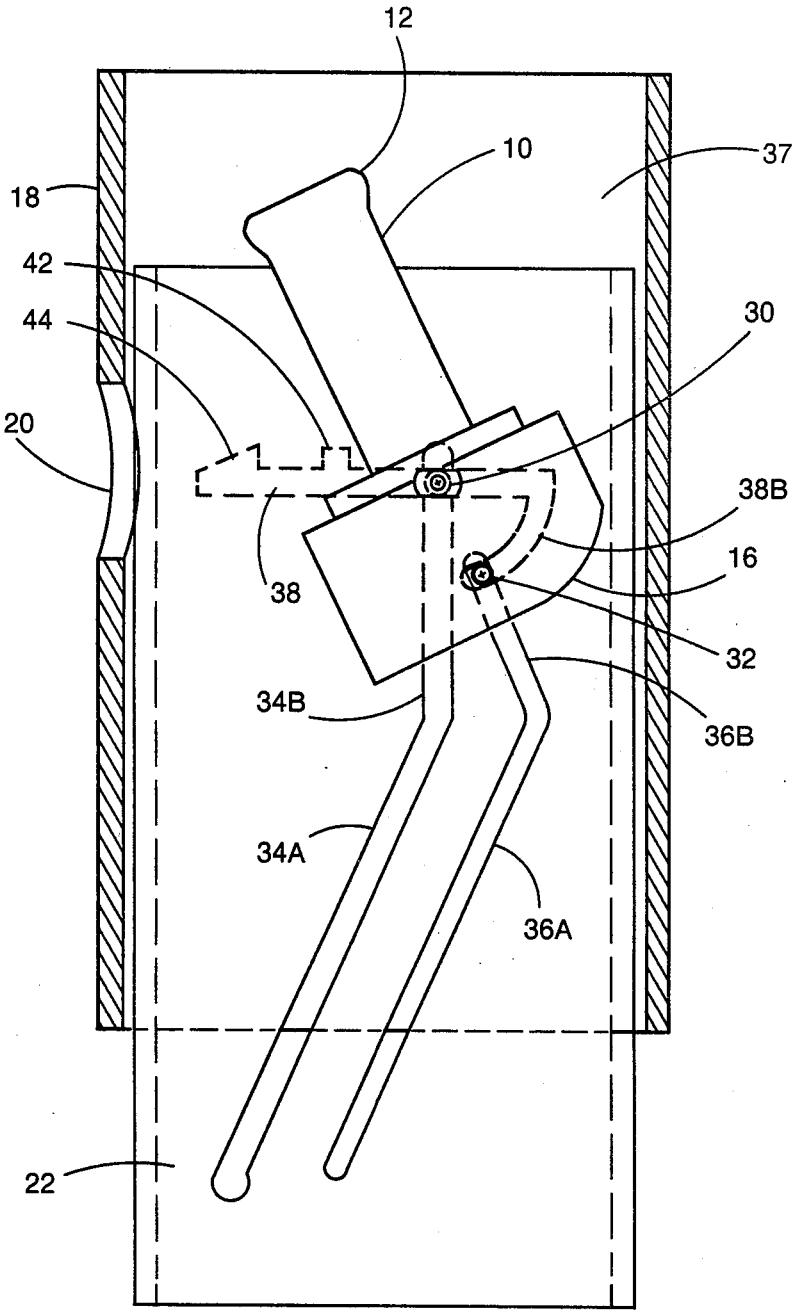
FIG. 10 is a plan view showing the relationship of the slots of the fixed plate and the drive plate when the core barrel is in a completely retracted and most upwardly tilted position.
Figure 11:
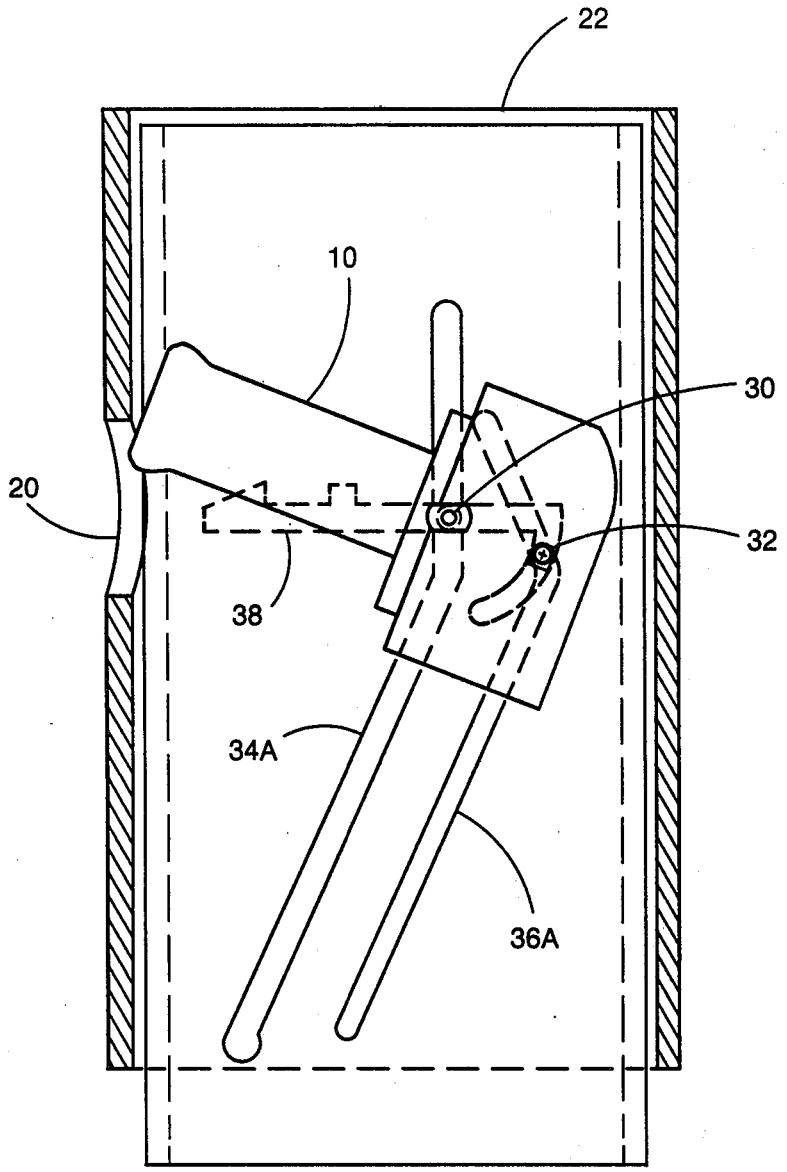
FIG. 11 is similar to FIG. 10 except the drive plate has been moved upwardly and the core barrel has been tilted downwardly.
Figure 12:
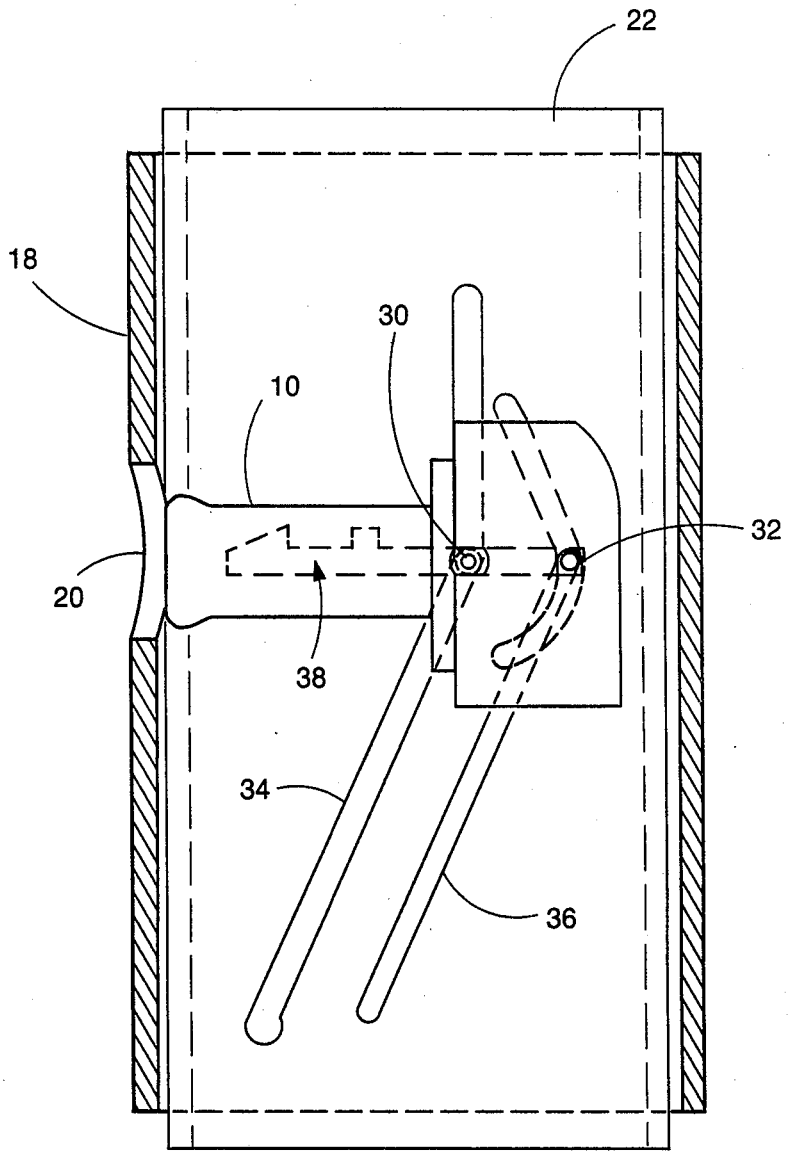
FIG. 12 is similar to FIG. 10 except in this figure the core barrel is in a horizontal position.

FIGS. 10–16 show the relationship of various relative positions between fixed plate 37 and the movable plate 22. The various parts shown in these Figures are identical except for the relationship caused by the change in the position of the movable or drive plate 22. In FIG. 10, core barrel 10 is tilted upwardly the maximum position for the particular configuration of guide slots. As can be seen the trailing pinion 32 is in the lower extremity of arcuate section 38B of the fixed slot. In FIG. 11, forward pinion 30 is still in the same position and only trailing pinion 38 has moved around the arcuate section 38B and core barrel 10 has been rotated downwardly from the position of FIG. 10. This is accomplished by movement of drive plate 22 upwardly from that shown in FIG. 10. In FIG. 12 drive plate 22 has continued to move upwardly and is now in a position where trailing pinion 32 is in line with the horizontal section of fixed slot 38. When in this position, the core barrel 10 is horizontal or perpendicular to the longitudinal axis of the fixed plate 37.

Figure 13:
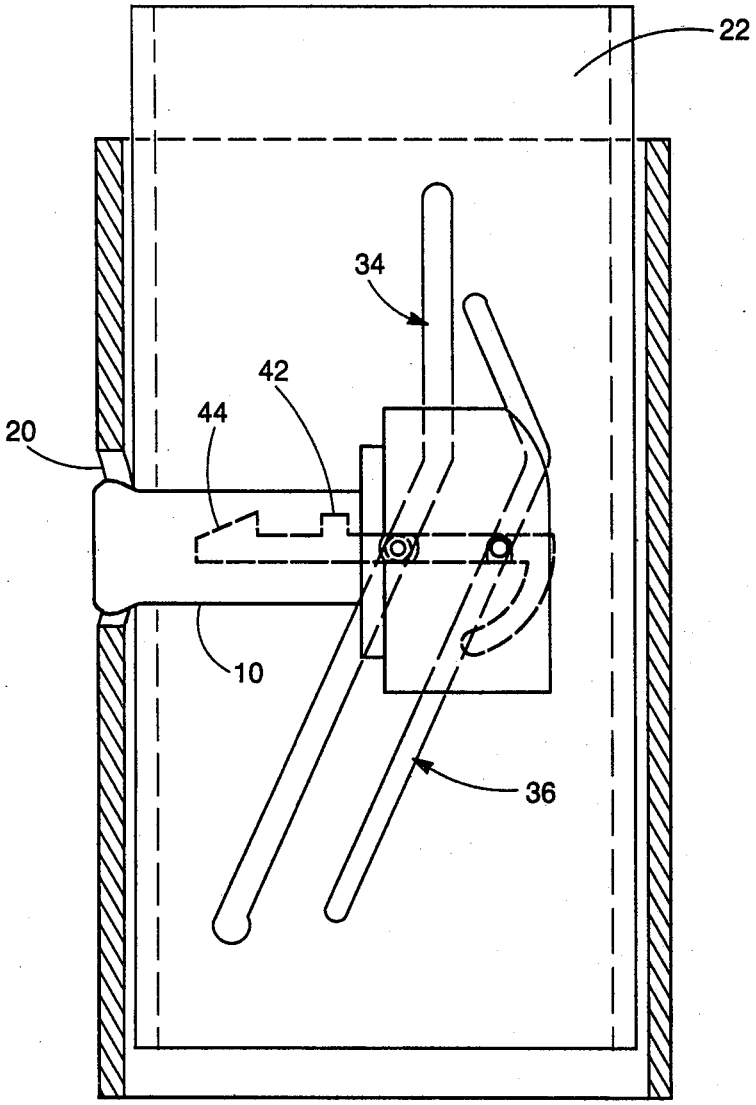
FIG. 13 is similar to FIG. 12 except the drive plate has been moved up slightly and the core barrel is slightly more extended than in FIG. 12.
Figure 14:
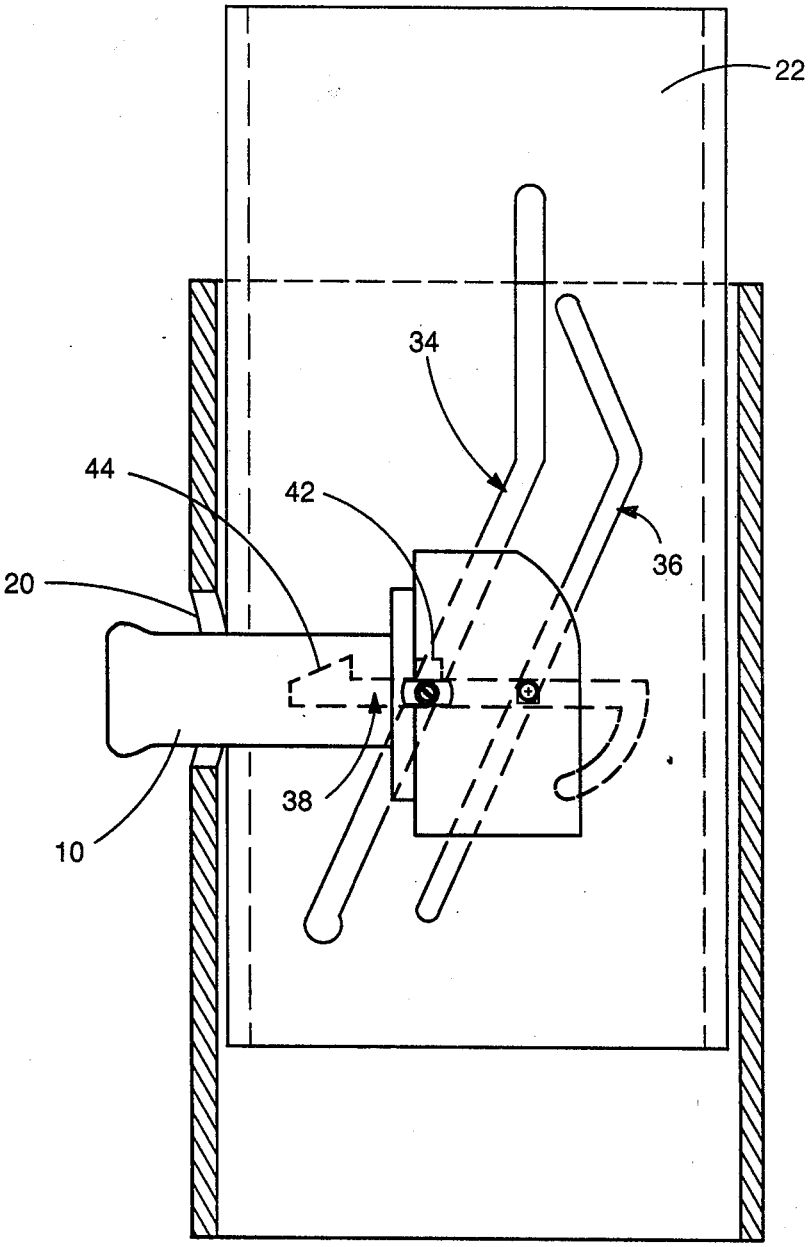
FIG. 14 is similar to FIG. 13 and shows the core barrel extended further.

Additional upward movement of drive plate 22 causes the core barrel 10 to extend through opening 20 and two steps in this sequence are shown in FIGS. 13 and 14. At about the stage shown in FIG. 13, motor 16 is actuated and remains operational until the core barrel is now in the position indicated in FIG. 15. For a fuller discussion of operations of motor 16, reference is made to said U.S. Pat. No. 4,280,569.

Figure 15:
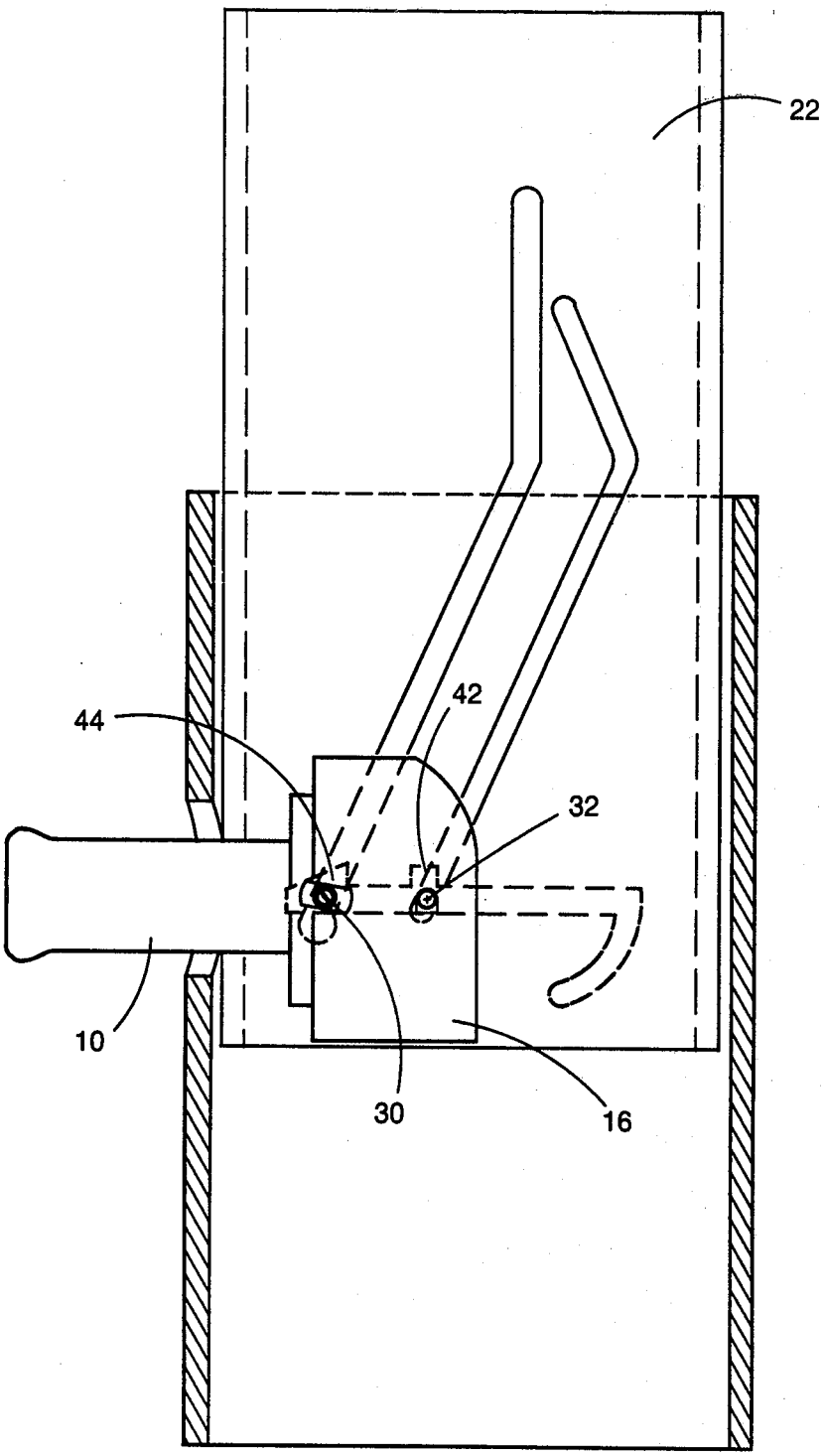
FIG. 15 is similar to FIG. 14 except the core barrel is extended to approximately the full limit.
Figure 16:
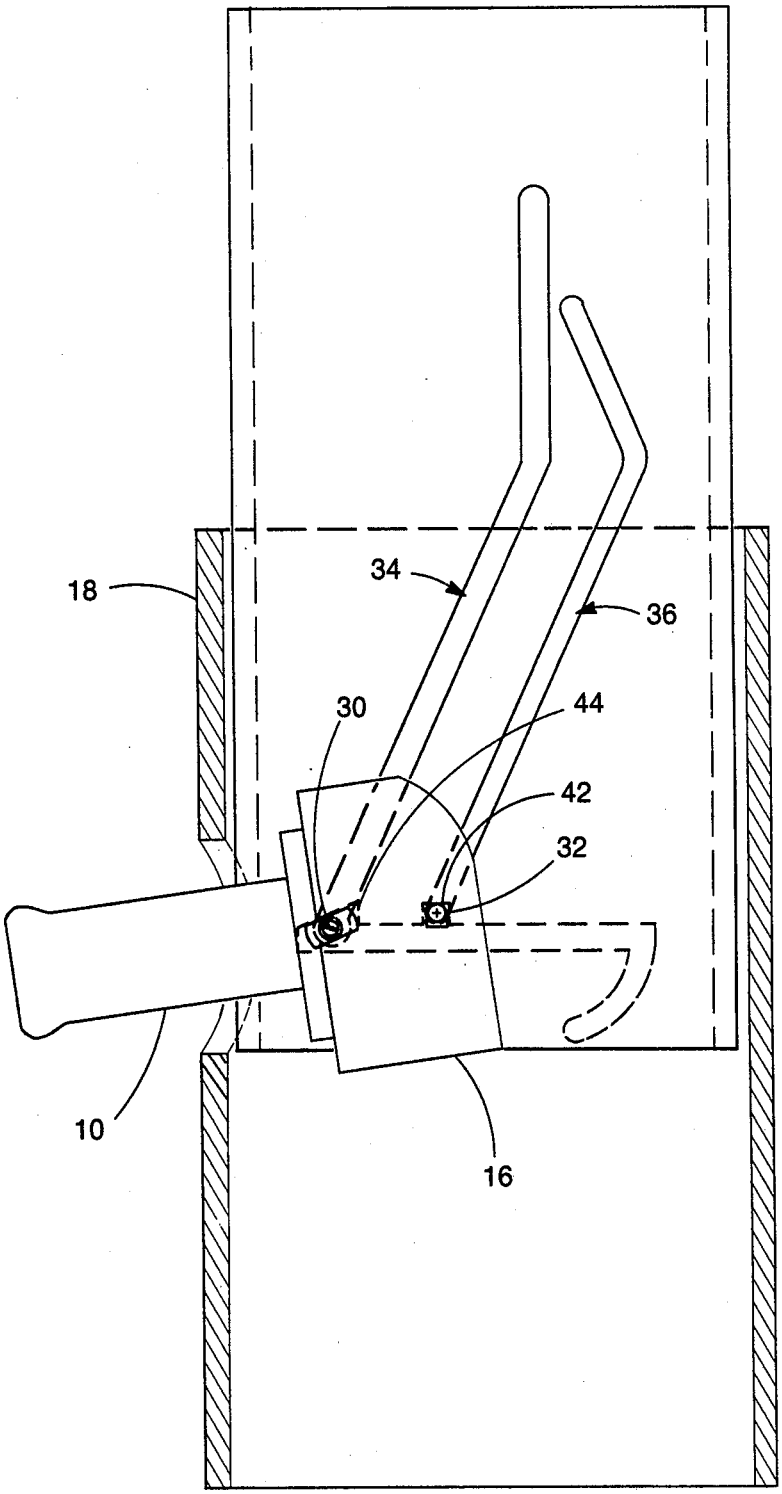
FIG. 16 is similar to FIG. 15 except that the pins of the motor have entered the break slots and the motor assembly has rotated upwardly by pivoting around the lower lip of the core head thus breaking the core loose from the rock.

Additional upward movement of plate 22 as indicated by its position shown in FIG. 15 causes the core barrel 10 to extend even further out to a nearly fully-extended position. The width 30A of pinion 30 is greater than the width of break slot 42 so that only trailing pinion 32 can enter break slot 42. This permits the movement illustrated in FIGS. 14, 15 and 16. FIG. 16 shows the pinions 30 and 32 in the break slots 44 and 42, respectively, of fixed slot 38. This shows that the hydraulic motor assembly has moved upward pivoting around the outer end of the core barrel 10 causing the core to break from the sidewall rock.

After the core has been cut and broken as indicated in FIG. 16, the core barrel can be retracted and returned to the position shown in FIG. 10 by merely moving the drive plate downwardly, and the sequence will be in the reverse order and will now be in the order of FIG. 16 back through FIG. 10.

Attention is next directed to FIGS. 17, 18, 19, 20, 21, 22, 23 and 24 which shows a mechanism for pushing the retrieved core positioned inside the core barrel 10 to a core retainer tube with means for indexing the cores. At the upper end of the fixed plate and supported from housing 18 there is provided a means for pushing the core out of core barrel 10 which includes a push rod housing 78 enclosing a piston actuated flexible push rod 76. The rod can be actuated by a hydraulic cylinder or other means not shown. After rod 76 ejects the core through motor 16, it is retracted from the core barrel 10 before the motor assembly is rotated to cut the next core.

Figure 17:
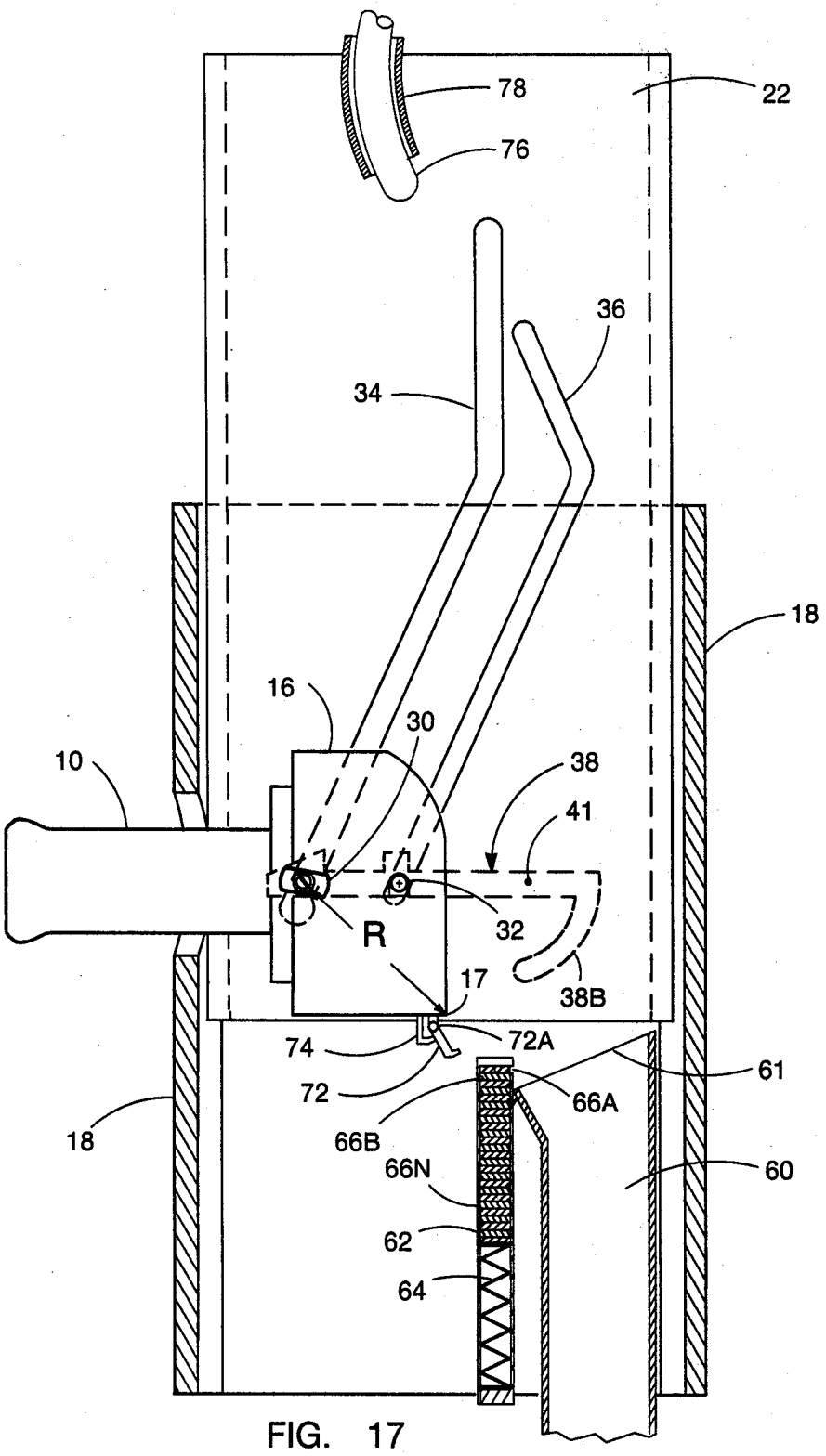
FIG. 17 is a schematic view of the core cutting mechanism showing the core expulsion and indexing means.

In FIG. 17, core barrel 10 is shown in its horizontally extended position in housing 18. At a lower position than the motor is core retaining tube 60 which has an enlarged mouth 61. Adjacent the core retaining tube 60 is a wafer retainer tube 62 having wafers 66A, 66B to 66N. Springs 64 urge wafers 66 toward the top of tube 62. However, as shown in FIGS. 18, 19 and 21, there is a top 68 having a lateral slot 70. Slot 70 of top 68 intersects a mouth 69 which is opened for about 180°. The wafers can be forced to slide outwardly toward the core retainer tube 60 once they are in the slot. As shown in the drawings and especially FIGS. 17 and 20, the lower side of motor 16 has provided on it a wafer ejector comprising stop 74, a tongue 72 pivoted at pivot 72A.

Figure 22:
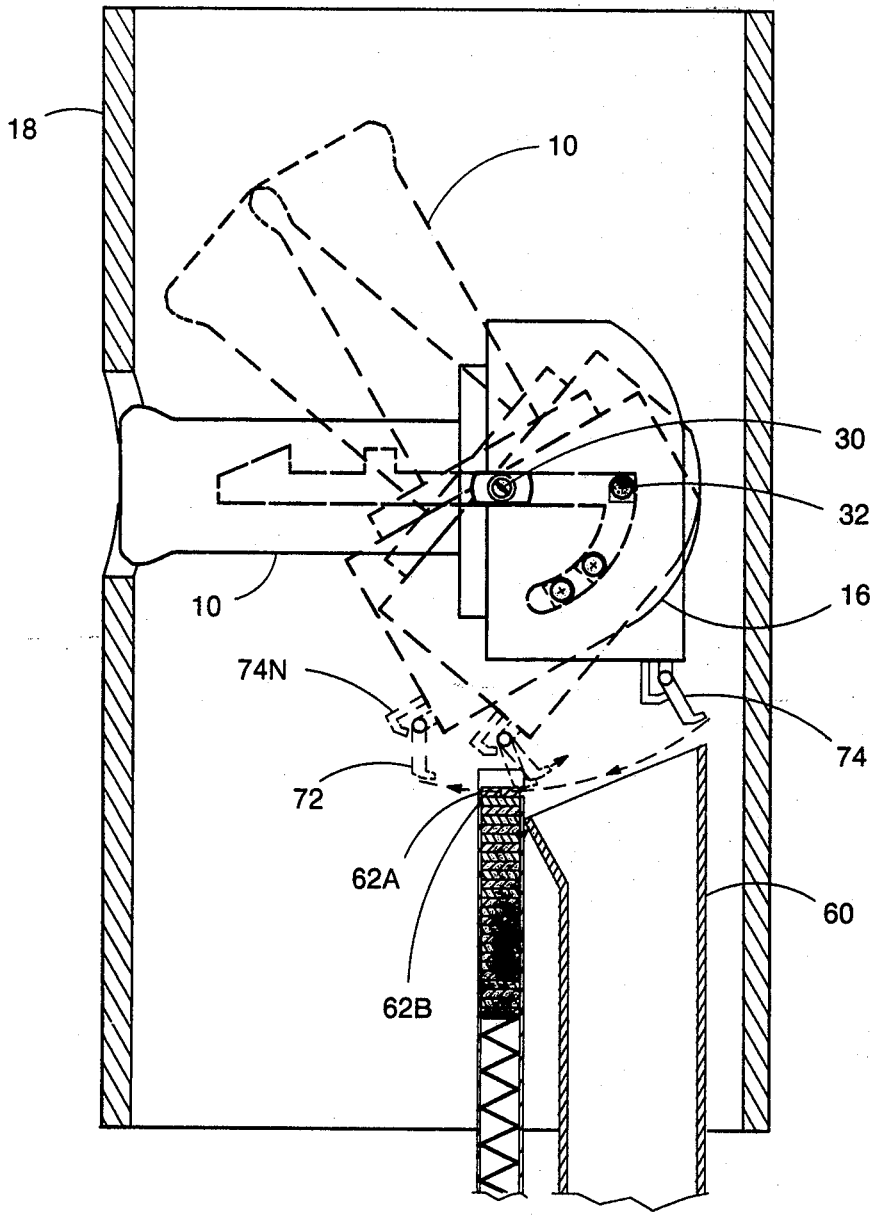
FIG. 22 illustrates by dashed lines various positions of the core barrel and index wafer ejection means as the barrel is rotated from its horizontal position to its most upward tilt.
Figure 23:
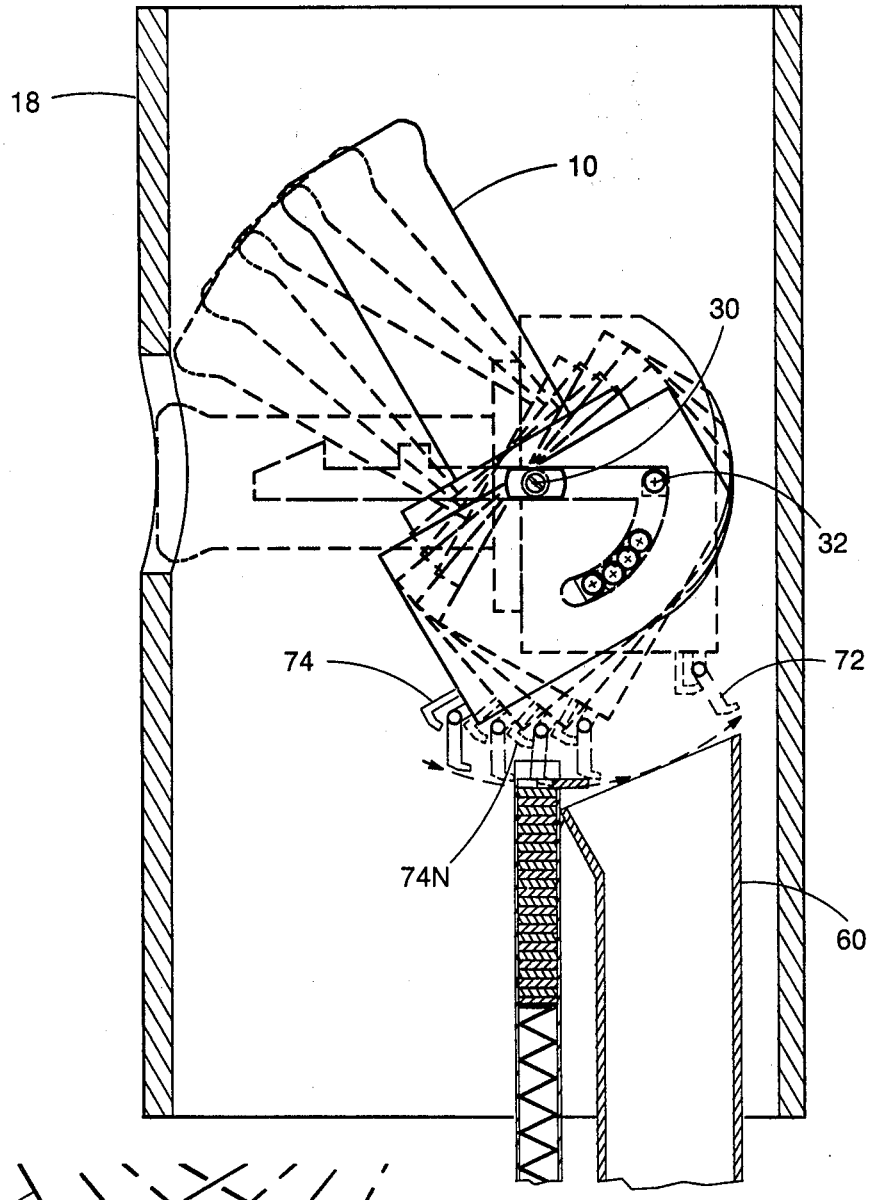
FIG. 23 is similar to FIG. 22 except that it illustrates various positions of the core barrel and index wafer ejection means as the core barrel is rotated from its uppermost tilted position to its horizontal position.
Figure 24:
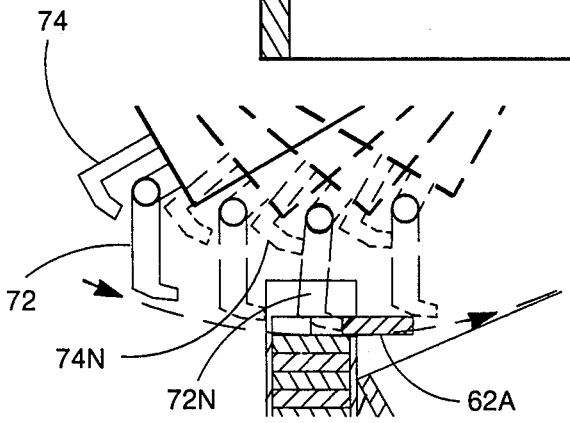
FIG. 24 is an enlarged view of the wafer ejection means of FIG. 23.

There is a hydraulic motor pivot point 41 on the center line of slot 38. This corresponds to the position of pinion 30 in FIG. 20. As the motor rotates about this pivot point, the pivot 72A of wafer injector tongue 72 rotates about an arc 73 having a radius R and pivot point 41 as its center, and comes in contact with the top 68 of wafer tube 62 on the extension of the core barrel and again upon its complete retraction. Attention is now directed to FIG. 20. Shown thereon is the core barrel 10 in its most upwardly tilted position. Push rod 76 is shown as forcing core 80A through the center of motor 16. The motor 16 is rotated about forward pinion 30 when it is at pivot point 41, the core barrel is being rotated from its tilted position to its horizontal position. This rotation causes wafer ejector 72 to go through pigtail slot 70 and force a wafer 66A out and into the core retainer 60. This is indicated as a lower wafer 66A' in FIG. 20. This action is clearly illustrated by the illustration in FIGS. 23 and 24 which illustrate various positions in dashed line contour of the ejector tongue 72 as core barrel 40 is rotated from its upward to the horizontal position. The stop at indicated position 74N prevents the rotation of tongue 72N and causes it to expel wafer 62A from wafer tube 62 to core retaining barrel 60. After the core has been cut, core barrel is again rotated upwardly to its tilted position as shown in FIG. 20. When this rotation occurs, wafer ejector 72 is pivoted about pivot point 72A and rides up and over cap 68 of the wafer retainer tube 62. During this rotation the wafers are not disturbed. This sequence of movement of the core barrel and motor assembly and ejector tongue 72 is illustrated in FIG. 22 by the dashed outlines of the core barrel, motor and ejection means. The return of the core barrel from its tilted position as shown in FIG. 20 to its horizontal position, is illustrated by the motion indicated in FIGS. 23 and 24. During this movement ejector 72 will force another wafer 62B out of wafer tube 62 into the core retaining tube 60. Thus, the cores 80 are each separated from the adjacent core by a numbered wafer so that the depth that each core was can be determined. If the core barrel should fail to cut a core during any cycle, there will be two wafers deposited, one immediately on top of the other, in core retaining tube 60. Thus, it is known that there is a missed depth at which no core was cut and retrieved.

Figure 25:
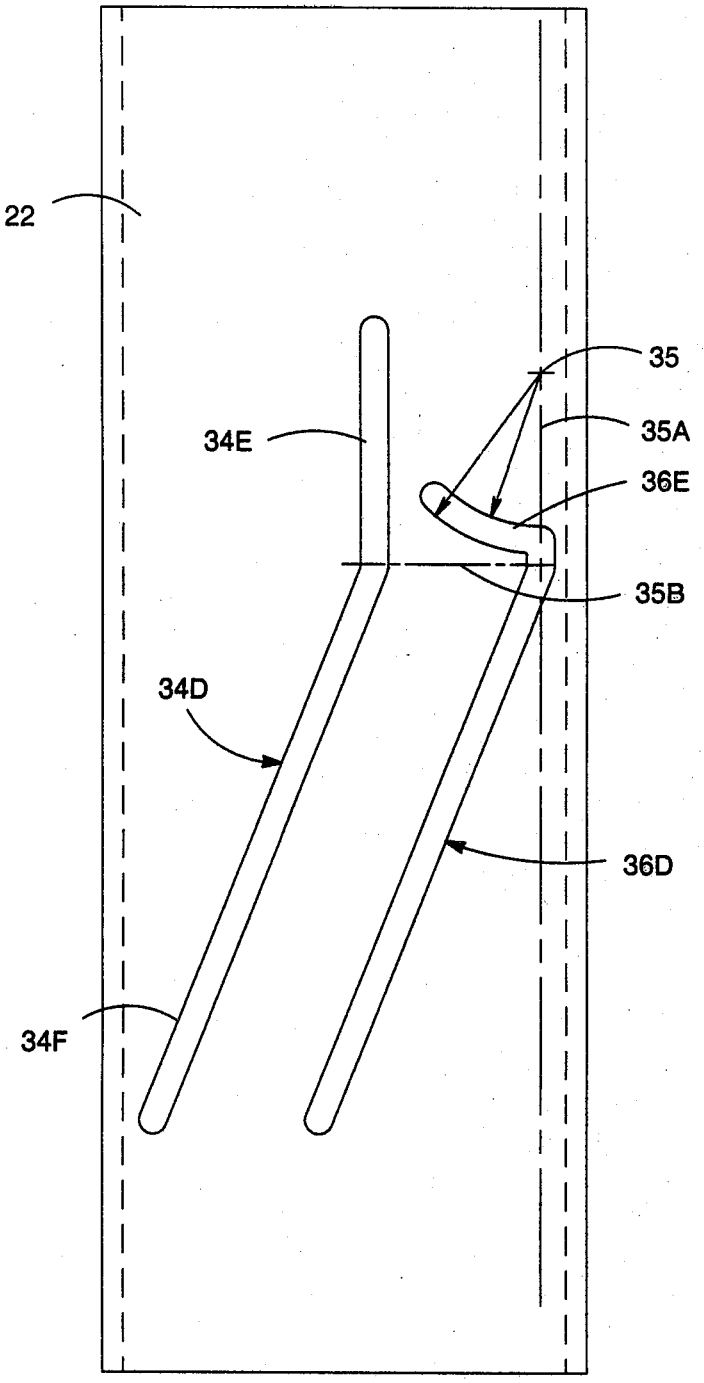
FIG. 25 illustrates a modification of the configuration of the slots on the drive plate.

FIG. 25 illustrates a modification of the configuration of the slot of drive plate 22. Slot 34D is the same as slot 34 shown in FIG. 4A. However, upper section 36B of slot 36 of FIG. 4A has been modified as indicated in FIG. 25 where upper section 36E of slot 36D is in the form of an arc which preferably has the same radius and length as arcuate section 38B illustrated in FIG. 3A. The center of arc or section 36E is at point 35 which lies on a line 35A parallel to the center line of upper section 34E of slot 34D. The center line of arcuate section 36E intersects line 35A at a point which is a distance above line 35B which is equal to the width of the slot 36D. Line 35B is perpendicular to the center line of upper section 34E and intersects the intersection of upper section 34E and lower section 34F.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What we claim is:

1. An apparatus for drilling a sidewall core comprising:

an elongated housing having an opening in the wall thereof;

a fixed plate means secured to said housing and having a guide slot substantially perpendicular to the longitudinal axis of the housing and an arcuate section at one end thereof;

a drive plate adjacent said fixed plate means and movable with respect to said housing and having a first and a second slot, said first slot having a first section parallel to the axis of said housing and a second section forming a selected angle with said first section;

said second slot having a lower section parallel to said second section and an upper section making a second selected angle with said lower section;

drive means to move said drive plate;

a bit assembly mounted to said housing and having guide means engaging said guide slot means and said first and second slot to extend and retract said assembly through said opening of said housing in response to the movement of said drive plate.

2. Apparatus for drilling from a borehole comprising:

an elongated housing having an opening in the wall thereof;

a fixed plate secured to said housing and having a guide slot including a first substantially straight section and arcuate section, said straight section being perpendicular to the longitudinal axis of said housing;

a drive plate adjacent said fixed plate and movable with respect to said housing in a direction parallel to its longitudinal axis;

drive means to move said drive plate;

a cutting assembly mounted in said housing and having guide means engaging such straight section and said arcuate section to extend and retract said assembly through said opening of said housing in response to the movement of said drive plate.

3. An apparatus as defined in claim 2 in which said drive plate has a drive plate slot means including (i) a forward slot having a lower straight section and an upper straight section with an angle $\emptyset$ therebetween;

(ii) a trailing slot having a lower straight section parallel to said lower straight section of said forward slot and an upper straight section making an angle $\beta$ with said lower straight section of said trailing slot, this angle $\beta$ being smaller than the said angle $\emptyset$.

4. An apparatus as defined in claim 2 in which said drive plate has a drive plate slot means including (i) a forward slot having a lower straight section and an upper straight section with an angle $\emptyset$ therebetween;

(ii) a trailing slot having a lower straight section parallel to said lower straight section of said forward slot and an upper arcuate section having a radius equal to the radius of said arcuate section of said fixed plate.

5. An apparatus as defined in claim 3 in which said angle $\emptyset$ is between about 140° and 170°, the angle $\beta$ is between about 120° and 140° and the angle m between the lower straight section of said forward slot and an intersecting straight line parallel to the longitudinal axis of said housing is between about 20° and 40°.

6. An apparatus as defined in claim 5 in which said angles $\emptyset$, $\beta$ and m respectively are about 155°, 130°, and 30°.

7. An apparatus as defined in claim 5 including a break slot at the lower end of said lower straight section of said forward slot.

8. An apparatus as defined in claim 2 in which said straight section has break notches at the end closest to said opening and the arcuate section is at the opposite end of said straight section and curves downwardly.

9. An apparatus as defined in claim 7 in which the straight section of said fixed plate has a first and a second upwardly facing break notch, said first break notch being near the end of said straight section of said fixed plate nearest said opening of said housing, the width of said second notch being less than the width of said first notch.

10. Apparatus as defined in claim 9 in which the guide means of said cutting assembly has a first pinion mounted in said forward slot and a second pinion mounted in said trailing slot, the size of said first pinion being too large to enter said second break notch and the radius of said arcuate section being equal to the distance between said first and second pinions.

11. An apparatus for drilling a borehole comprising:

an elongated housing having an opening in the wall thereof;

a fixed plate secured to said housing and having a guide slot including a first substantially straight section and an arcuate section;

a drive plate adjacent said fixed plate and movable with respect to said housing in a direction parallel to its longitudinal axis, said drive plate including (i) a forward slot having a lower straight section and an upper straight section with an angle $\emptyset$ therebetween;

(ii) a trailing slot having a lower straight section parallel to said lower straight section of said forward slot and an upward straight section making an angle $\beta$ with said lower straight section of said trailing slot, angle $\beta$ being smaller than angle $\emptyset$;

drive means to move said drive plate; and a cutting assembly mounted in said housing and having guide means engaging such straight section and said arcuate section to extend and retract said assembly through said opening of said housing in response to the movement of said drive plate.

12. An apparatus for drilling a borehole comprising:

an elongated housing having an opening in the wall thereof;

a fixed plate secured to said housing and having a guide slot including a first substantially straight section and an arcuate section;

a drive plate adjacent said fixed plate and movable with respect to said housing in a direction parallel to its longitudinal axis, said drive plate slot including (i) a forward slot having a lower straight section and an upper straight section with an angle $\emptyset$ therebetween;

(ii) a trailing slot having a lower straight section parallel to said lower straight section of said forward slot and an upper arcuate section having a radius equal to the radius of said arcuate section of said fixed plate.

drive means to move said drive plate; and a cutting assembly mounted in said housing and having guide engaging such straight section and said arcuate section to extend and retract said assembly through said opening of said housing in response to the movement of said drive plate.

13. A method of cutting a core sample from the sidewall of a borehole using a motor assembly having a hollow passage through said motor, a core barrel and a bit at the end of the core barrel all mounted in a housing and extendable through an opening which comprises:

a. extending said core barrel through said opening and operating said assembly to cut a core which is contained in said barrel;

b. separating the attached end of said core from said sidewall;

c. retracting said core barrel;

d. then tilting said core barrel so that the bit end of said core barrel is higher than the other end, and then e. forcing said core out of said barrel through said motor by applying a force to the core.

14. A method as defined in claim 13 including indexing the core forced out of said barrel and then cutting a second core by again performing steps a, b, c, d, and e.

15. An apparatus for cutting a core from the sidewall of a borehole comprising:

a housing with an opening, a cutting assembly having an open centered motor connected to a core barrel with a core bit at the outer end;

guide means for guiding said core barrel between an extended position essentially perpendicular to the longitudinal axis of said housing to a second position in which the end of said core barrel where the bit is attached, is higher than the other end;

means to drive the core from said core barrel through said core barrel and said motor when said core barrel is in said second position.

16. An apparatus as defined in claim 15 including means to index each cut core.

17. An apparatus as defined in claim 15 or 16 including a core retainer tube having a funnel positioned such that it is beneath said motor when said cutting assembly is in an upward tilted position;

a wafer tube adjacent said core tube retainer;

a plurality of wafers in said wafer tube being urged upwardly by a resilient means;

a top means on said wafer tube, said top means having a lateral slot across the diameter thereof and the side of said slot adjacent said core tube retainer being open in an arc of approximately 180°;

a wafer ejector attached to said motor including a tongue pivotally attached to said motor at a position to pass through said slot of said cap of said wafer tube upon rotation of said motor between said first and second positions and a wafer injected tongue stop means adjacent the pivot of said tongue to limit the pivotal movement of said tongue such that when said motor rotates from said second position to said first position, said tongue pushes said wafer out of said top means toward the top of said funnel.

* * * * *